US011798728B2

(12) United States Patent
Saadat

(10) Patent No.: US 11,798,728 B2
(45) Date of Patent: Oct. 24, 2023

(54) BALANCED, SYMMETRICAL COIL

(71) Applicant: DSBJ Pte. Ltd., Singapore (SG)

(72) Inventor: Soheil Saadat, Irvine, CA (US)

(73) Assignee: DSBJ PTE. LTD., Singapore (SG)

( * ) Notice: Subject to any disclaimer, the term of this patent is extended or adjusted under 35 U.S.C. 154(b) by 431 days.

(21) Appl. No.: 17/265,906

(22) PCT Filed: Sep. 9, 2019

(86) PCT No.: PCT/US2019/050132
§ 371 (c)(1),
(2) Date: Feb. 4, 2021

(87) PCT Pub. No.: WO2020/055710
PCT Pub. Date: Mar. 19, 2020

(65) Prior Publication Data

US 2021/0193371 A1 Jun. 24, 2021

Related U.S. Application Data

(60) Provisional application No. 62/730,159, filed on Sep. 12, 2018.

(51) Int. Cl.
*H01F 5/00* (2006.01)
*H01F 27/28* (2006.01)
(Continued)

(52) U.S. Cl.
CPC ..... *H01F 27/2804* (2013.01); *H01F 5/00* (2013.01); *H01F 27/29* (2013.01); *H01F 41/041* (2013.01)

(58) Field of Classification Search
CPC .... H01F 27/2804; H01F 27/29; H01F 41/041; H01F 38/14; H01F 5/003; H01F 17/00;
(Continued)

(56) References Cited

U.S. PATENT DOCUMENTS

2008/0157913 A1 7/2008 Kim
2009/0085706 A1 4/2009 Baarman et al.
(Continued)

FOREIGN PATENT DOCUMENTS

CN 1906717 A 1/2007
CN 102376415 A 3/2012
(Continued)

OTHER PUBLICATIONS

Official Communication issued in corresponding British Patent Application No. GB2102972.3, dated Feb. 9, 2022.
(Continued)

*Primary Examiner* — Tuyen T Nguyen
(74) *Attorney, Agent, or Firm* — KEATING & BENNETT, LLP

(57) ABSTRACT

A coil device includes a first conductor on a first layer and arranged in a first spiral shape, a second conductor on a second layer and arranged in a second spiral shape, a transition that connects the first conductor and the second conductor in series, a first terminal connected to an end of the first conductor, and a second terminal connected to an end of the second conductor. The first terminal and the second terminal are outside of the first conductor and the second conductor when viewed in plan. The first conductor and the second conductor each include a plurality of in-plane traces connected in parallel with each other.

10 Claims, 11 Drawing Sheets

(51) Int. Cl.
*H01F 27/29* (2006.01)
*H01F 41/04* (2006.01)

(58) Field of Classification Search
CPC ..... H01F 27/28; H01F 41/04; H01F 17/0013; H01F 2017/0073; H01F 2027/2809
See application file for complete search history.

(56) References Cited

U.S. PATENT DOCUMENTS

| | | | | |
|---|---|---|---|---|
| 2009/0184794 | A1 | 7/2009 | Tsuzuki | |
| 2011/0133877 | A1 | 6/2011 | Chiu et al. | |
| 2012/0044034 | A1 | 2/2012 | Nazarian et al. | |
| 2012/0326931 | A1 | 12/2012 | Murayama et al. | |
| 2013/0069753 | A1* | 3/2013 | Kurs | H01F 5/003 336/200 |
| 2013/0328163 | A1 | 12/2013 | Cheng et al. | |
| 2015/0145635 | A1 | 5/2015 | Kurz et al. | |
| 2016/0049237 | A1* | 2/2016 | Yosui | H01F 27/2804 336/200 |
| 2016/0094082 | A1 | 3/2016 | Ookawa et al. | |
| 2016/0126001 | A1 | 5/2016 | Chien et al. | |
| 2017/0103849 | A1 | 4/2017 | Leem | |
| 2017/0133152 | A1 | 5/2017 | Kouchi et al. | |
| 2017/0228721 | A1 | 8/2017 | Lee et al. | |
| 2018/0358174 | A1 | 12/2018 | Komachi et al. | |
| 2021/0272738 | A1* | 9/2021 | Chiyo | H01F 27/2871 |

FOREIGN PATENT DOCUMENTS

| | | | |
|---|---|---|---|
| CN | 204741068 | U | 11/2015 |
| CN | 109087791 | A | 12/2018 |
| EP | 1 324 375 | A2 | 7/2003 |
| EP | 2 421 011 | A1 | 2/2012 |
| EP | 3609051 | A1 | 2/2020 |
| EP | 3629444 | A1 | 4/2020 |
| JP | 4201043 | A | 12/2008 |
| JP | 2013-251455 | A | 2/2013 |
| KR | 10-2015-0055733 | A | 5/2015 |
| KR | 10-2017-0043393 | A | 4/2017 |
| KR | 10-1760233 | B1 | 7/2017 |
| KR | 10-2017-0093020 | A | 8/2017 |
| KR | 10-2018-0043993 | A | 5/2018 |
| WO | 98/43258 | A2 | 10/1998 |

OTHER PUBLICATIONS

Official Communication issued in International Patent Application No. PCT/US2019/050132, dated Jan. 2, 2020.
Official Communication issued in corresponding Chinese Patent Application No. 201980060084.9, dated Dec. 27, 2022.
Official Communication issued in corresponding European Patent Application No. 19859910.2, dated May 12, 2022.
Official Communication issued in corresponding Korean Patent Application No. 10-2021-7007073, dated Feb. 11, 2022.

* cited by examiner

BALANCED, SYMMETRICAL COIL

BACKGROUND OF THE INVENTION

1. Field of the Invention

The present invention relates to coils. More specifically, the present invention relates to balanced, symmetrical coils in a flexible printed circuit (FPC) that can be used in electronic device applications.

2. Description of the Related Art

Conventional receiver (Rx) coils include a continuous round copper wire 800 formed in a circular spiral shape as shown in FIG. 8. The round Rx coil wire 800 has a shielding insulation or coating on an outer surface that allows them to have tight spacing between each turn without creating a short circuit between wires in adjacent turns of the Rx coil. As a result, an Rx coil similar to that shown in FIG. 8 will have a relatively low resistance.

While conventional Rx coils with round wires, such as that shown in FIG. 8, demonstrate good performance, they are not always suitable for device integration due to the space limitations in cell phones, tablets, and other electronic devices. Additionally, to connect to the inner terminal of the Rx coil, a connection bridge needs to be formed across the Rx coil to extend the inner terminal to outside of the Rx coil, as shown in FIG. 9.

FIG. 9 is a perspective view of an Rx coil similar to that shown in FIG. 8, but with a connection bridge 940 over the Rx coil. FIG. 9 shows that the connection bridge 940 is a cross-over portion from the inner terminal 910 to an area outside of the Rx coil. This connection bridge 940 creates a contact 932 of the inner terminal 910 adjacent to a contact 934 for the outer terminal 930 that connects to outside circuitry. As a result, the connection bridge 940 increases the overall thickness of the Rx coil device.

Rx coils can also be made in FPCs, but the fabrication, handling, and assembly of round wire Rx coils in mass production are not as simple as those of FPC Rx coils. Typically, an array of FPC Rx coils are simultaneously fabricated in large panels that are subsequently cut into individual Rx coil devices.

In an FPC Rx coil, the conventional round insulated copper wire is replaced by traces with rectangular cross-sections that can be more simply fabricated. The traces can be formed in either circular shapes as shown in FIG. 10 or in rectangular shapes as shown in FIG. 11. FIG. 10 shows a conventional circular shaped FPC Rx coil having a trace 1000 with a rectangular cross-section. FIG. 11 shows a conventional rectangular shaped FPC Rx coil having a trace 1100 with a rectangular cross-section. As shown in FIGS. 10 and 11, FPC Rx coils are much more versatile in terms of design, and multiple shapes are possible without forming or kinking round wires. If a lower resistance is desired, it is also simpler to make a multilayer FPC Rx coil than a multilayer round wire Rx coil.

FPC Rx coils, like conventional round wire coils, have two terminals, one inside and one outside of the Rx coil. To access the inner terminal, another conductive layer is added to form a connection bridge, similar to that discussed with respect to FIG. 9. Therefore, a dedicated conductive layer is needed to route a connection between the inner terminal and the outside circuit.

Even in multilayer coils, identical Rx coils are defined on top of each other in a parallel configuration, and the terminals on each end of the Rx coils are connected to the corresponding terminals on the adjacent layer through vias. This configuration is essential because the direction of the current on each Rx coil should remain the same at all times.

A major constraint in designing hardware for electronic devices, especially small electronic devices, is the volume of the device. Therefore, efficient use of the space in electronic devices is essential to achieve the highest possible performance. In conventional Rx coil designs, the extra layer or wire required for the connection bridge uses indispensable space without contributing to the electrical performance of the device. If the connection bridge can be eliminated, then the available space can be used to improve the Rx coil performance (by allocating the entire conductive layer to be an additional Rx coil), accessed by another performance enhancing feature in the device, or eliminated to allow for a thinner structure. Thus, with no connection bridge, the FPC Rx coil design becomes more symmetric and a similar fabrication process can be used for each layer.

SUMMARY OF THE INVENTION

To overcome the problems described above, preferred embodiments of the present invention provide balanced, symmetrical coils in a flexible printed circuit that can be used in electronic device applications.

According to a preferred embodiment of the present invention, a coil device includes a first conductor on a first layer and arranged in a first spiral shape, a second conductor on a second layer and arranged in a second spiral shape, a transition that connects the first conductor and the second conductor in series, a first terminal connected to an end of the first conductor, and a second terminal connected to an end of the second conductor. The first terminal and the second terminal are outside of the first conductor and the second conductor when viewed in plan. The first conductor and the second conductor each include a plurality of in-plane traces connected in parallel with each other.

The first conductor and the second conductor preferably have a rectangular cross section. The first spiral shape is preferably a circular spiral shape or a rectangular spiral shape. The second spiral shape is preferably a circular spiral shape or a rectangular spiral shape. A number of layers including the first layer and the second layer is preferably even. A width of the first conductor or the second conductor preferably changes along a length of the first conductor or the second conductor. A center portion of the first conductor or the second conductor is preferably wider than an inner portion and an outer portion of the first conductor or the second conductor. The coil device further preferably includes a flexible printed circuit structure that includes the first layer and the second layer. The plurality of in-plane traces preferably includes at least four traces.

According to a preferred embodiment of the present invention, an electronic device includes the coil device according to one of the various preferred embodiments of the present invention.

According to a preferred embodiment of the present invention, a method of manufacturing a coil device includes forming a first conductor in a first spiral shape on a first layer, forming a second conductor in a second spiral shape on a second layer, connecting the first conductor to the second conductor in series, and forming a first terminal connected to an end of the first conductor and a second terminal connected to an end of the second conductor terminal. The first terminal and the second terminal are outside of the first conductor and the second conductor when viewed in plan. The first conductor and the second conductor each include a plurality of in-plane traces connected in parallel with each other.

The above and other features, elements, characteristics, steps, and advantages of the present invention will become more apparent from the following detailed description of preferred embodiments of the present invention with reference to the attached drawings.

DETAILED DESCRIPTION OF PREFERRED EMBODIMENTS

Figure 1:
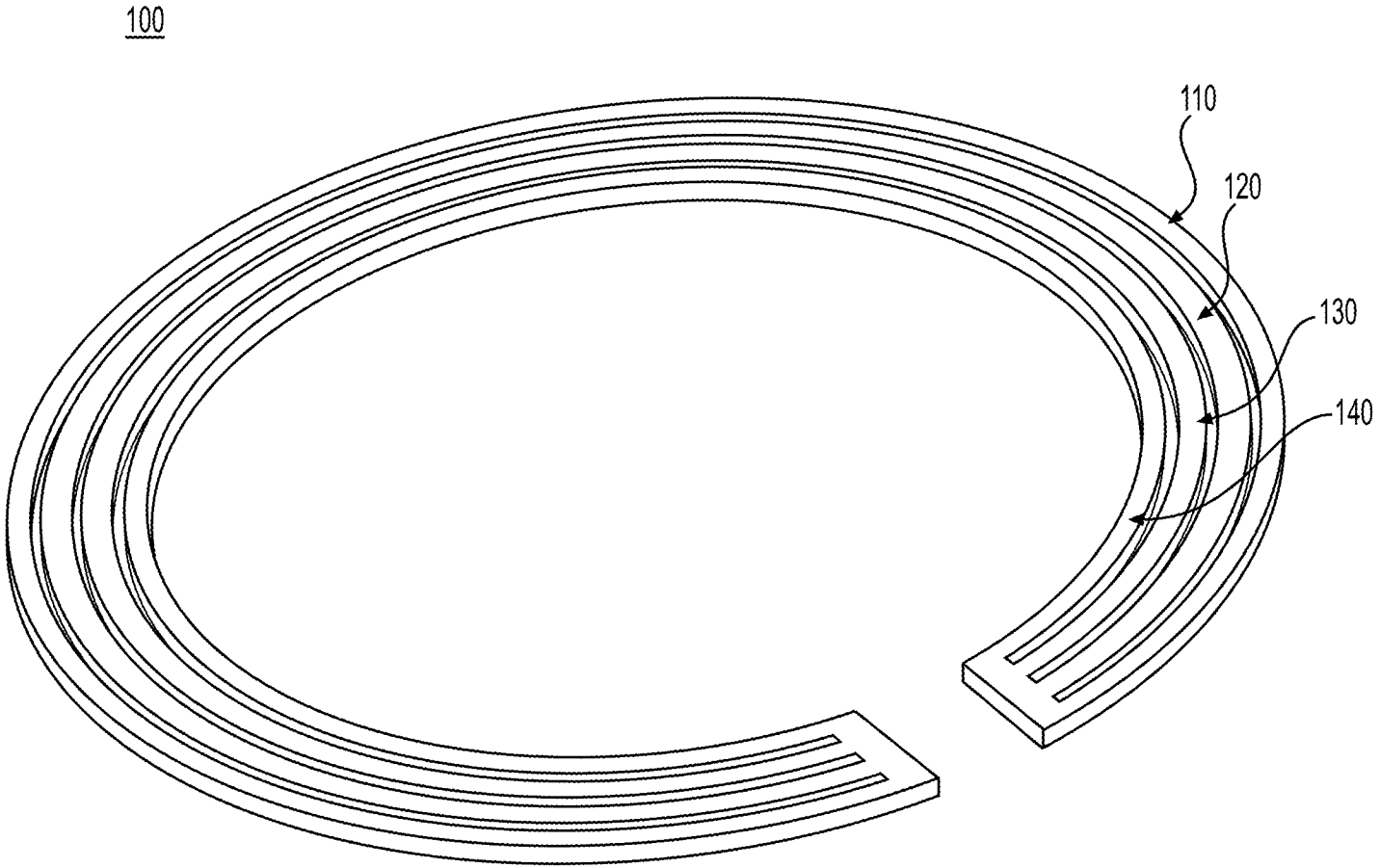
FIG. 1 shows a circular shaped coil wiring with a rectangular cross-section in an FPC that includes four in-plane parallel traces.

A balanced, symmetrical flexible printed circuit (FPC) coil significantly reduces or minimizes required space and obtains significantly increased maximum efficiency in small electronic device applications, such as cell phones, tablets, etc. FIG. 1 shows an example of a circular shaped coil 100 including wiring with a rectangular cross-section in an FPC that includes four in-plane parallel traces 110, 120, 130, 14. To enhance coil performance, a topology includes in-plane parallel traces that are connected in series with other in-plane parallel traces on a different layer. As shown in FIG. 1, the four traces 110, 120, 130, 140 in the same layer can be connected in parallel. Although FIG. 1 shows four traces 110, 120, 130, 140, it is possible to use any number of traces, including, for example, four, five, or six traces.

Figure 2:
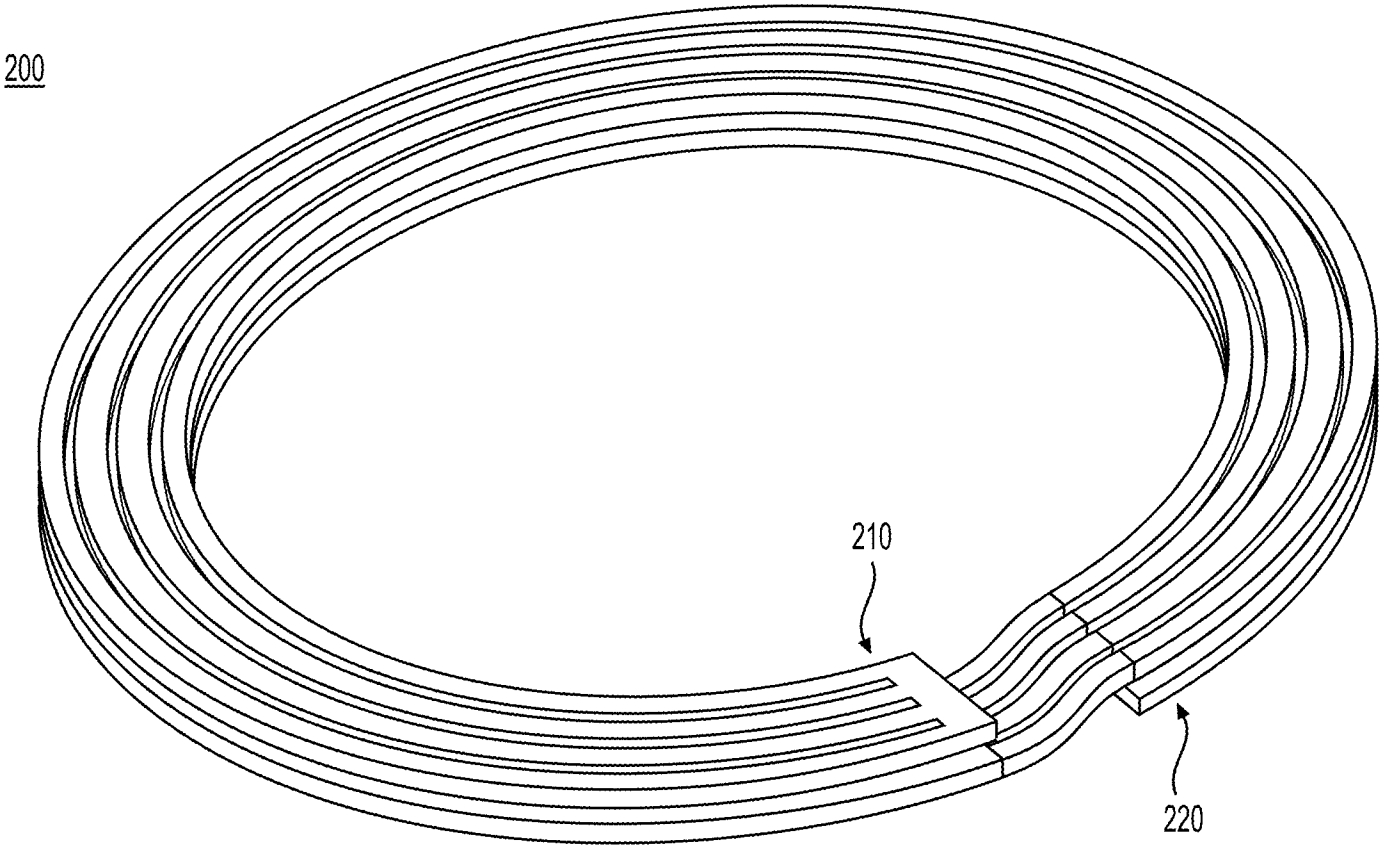
FIG. 2 is a view of wiring of two circular shaped coils in an FPC with four in-plane parallel traces where the two coils are in two different layers.

FIG. 2 shows an example of wiring of two circular shaped coils 200 in an FPC with four in-plane parallel traces, where the two coils are in two different layers, a first coil 210 in one layer and a second coil 220 in another layer. Although not shown, one of ordinary skill in the art would appreciate that an insulating layer is located between the two coils 210, 220. Connecting the two coils 210, 220 in series helps to increase or maximize the loop area, which increases incoming/outgoing magnetic flux. In this configuration, a connection bridge is not needed by limiting the number of layers to even numbers so both terminals are on one side. For example, a two-layer structure with series configuration similar to that shown in FIG. 2 eliminates the need for a cross-over connection bridge that requires additional space. In addition, coil performance can be optimized by adjusting parameters such as trace width, spacing, and thickness. Although FIG. 2 shows four in-plane traces, it is possible to use any number of in-plane traces, including, for example, four, five, or six in-plane traces.

Figure 3:
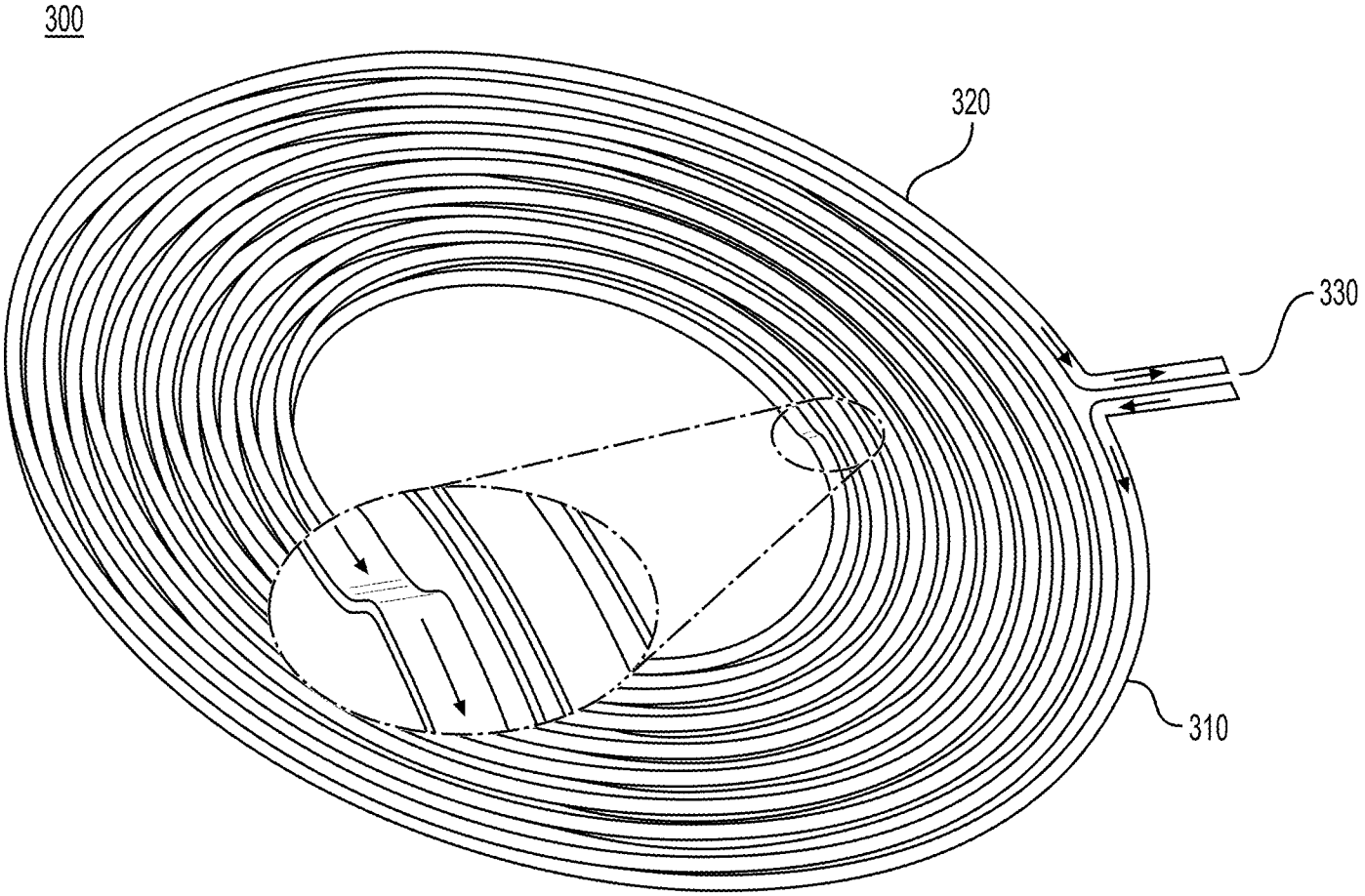
FIG. 3 is a plan view of a two-layer coil structure including contact terminals.
Figure 4:
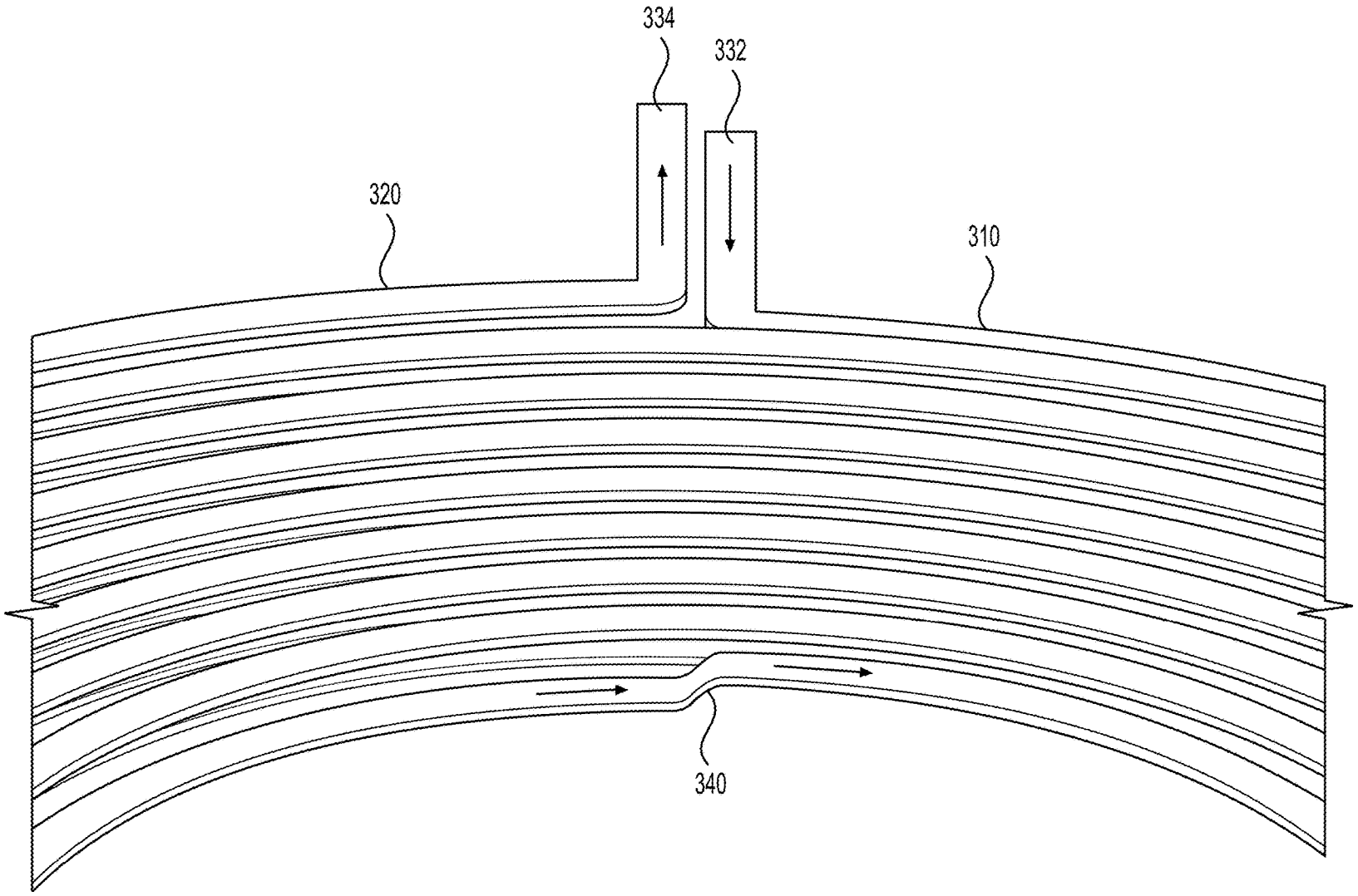
FIG. 4 is a side perspective view of a two-layer coil structure.

FIGS. 3 and 4 show a balanced, symmetrical two-layer coil 300 with different layers connected in series. FIG. 3 shows a plan view of the two-layer coil structure including the contact terminals 330. In FIG. 3, the wiring of the upper-layer coil 320 is seen to overlay the wiring in the lower-layer coil 310. FIG. 4 shows a side perspective view of the two-layer coil structure. The arrows in FIGS. 3 and 4 indicate the possible direction of current flow. It is also possible that the current flows in the opposite direction. As shown in FIGS. 3 and 4, the direction of current flow is into the contact terminal 332 of the lower-layer coil 310 and out from the contact terminal 334 of the upper-layer coil 320. As shown, the current flows from the lower-layer coil 310 to the upper-layer coil 320 through a layer transition or via 340 and routed to the upper-layer contact terminal 334 without a connection bridge. The transition or via 340 can be located adjacent to the center of the coil 300. With this configuration, the required inductance of the coil 300 can be achieved with a fewer number of turns and a more efficient use of space.

Figure 5:
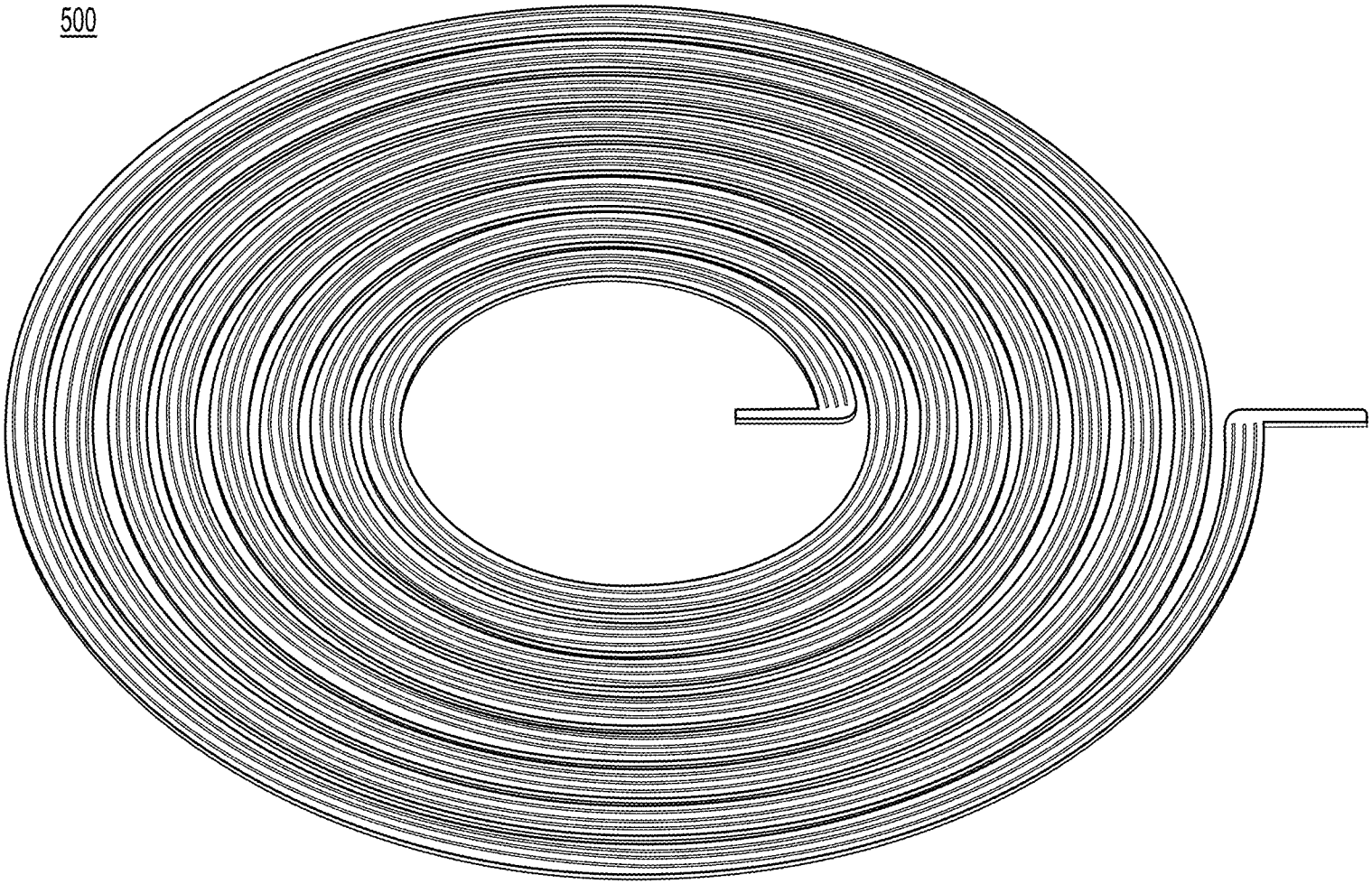
FIG. 5 shows an in-plane parallel configuration of one coil with four parallel wiring traces in the same conductive layer.

Using fewer turns in the coil leads to overall lower resistance. Unlike conventional coils in which coils on different layers are connected in parallel, a series configuration does not require tight spacing between each turn. Thus, process variation in fabrication does not have a significant impact on the coil performance. In addition, an in-plane parallel wiring configuration reduces the resistance of the coil even further. For example, FIG. 5 shows an in-plane parallel configuration of one coil 500 with four parallel wiring traces in the same layer. Although FIG. 5 shows four parallel traces, it is possible to use any number of parallel traces, including, for example, four, five, or six parallel traces.

Figure 6:
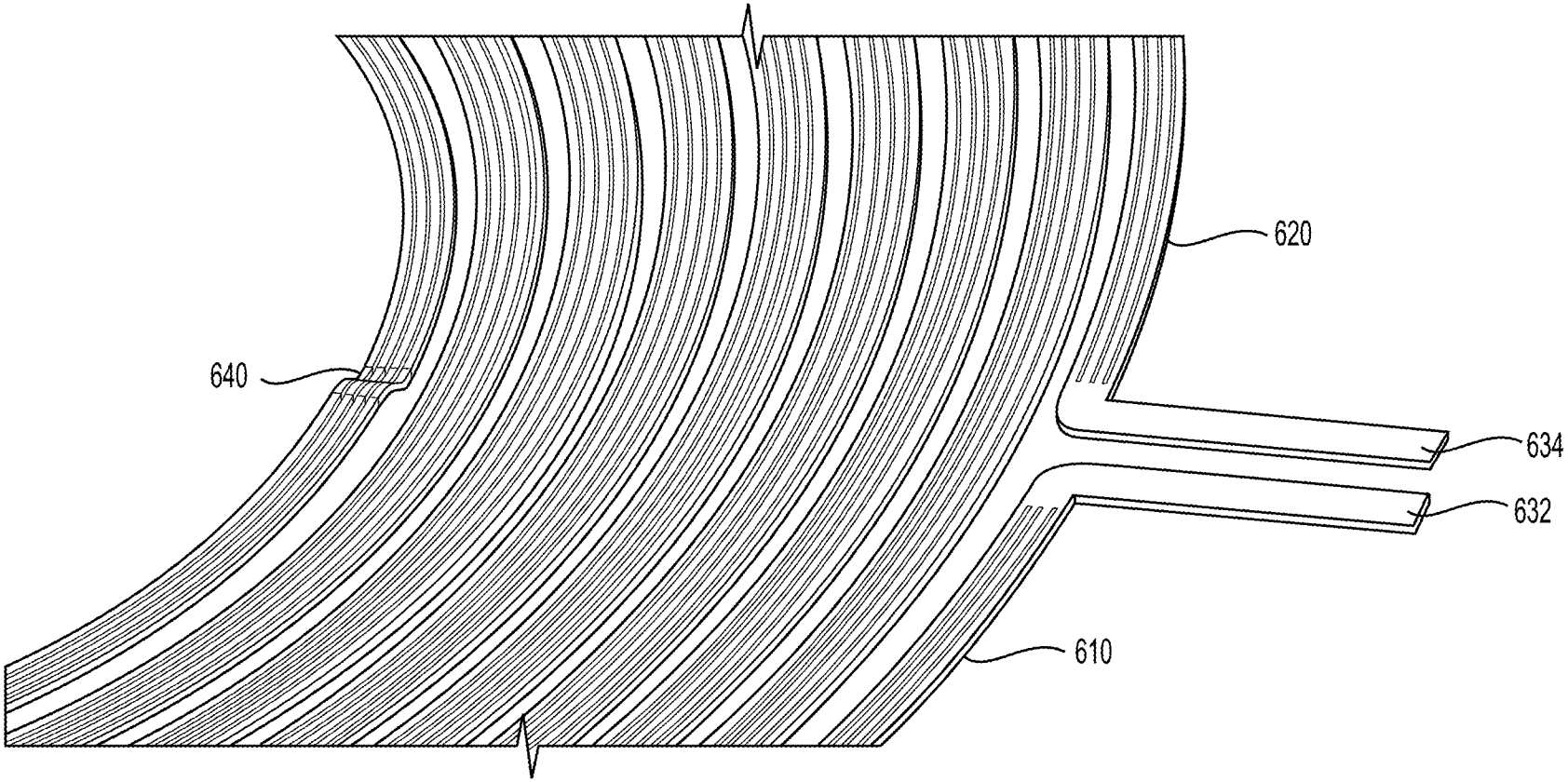
FIG. 6 is a view of a preferred embodiment of the current invention showing four in-plane parallel traces on the same layer combined with the series configuration of two coils in different layers.

A parallel trace configuration leads to a lower overall coil resistance compared to single wider traces. FIG. 6 shows in-plane traces of a coil connected in parallel combined with different layers of the coil connected in series. FIG. 6 shows a two-layer coil with a plurality of evenly spaced or substantially evenly spaced within manufacturing tolerances conductors arranged in a spiral shape. The spiral shape of the two layers can be the same spiral shape or can be different. For example, the spiral shape on the top layer can have a different number of loops than the spiral shape on the bottom layer. Each of the conductors in FIG. 6 can include four in-plane traces that are connected in parallel and evenly spaced or substantially evenly spaced within manufacturing tolerances from each other. It is possible to provide more or less than four in-plane traces. For example, four, five, or six in-plane traces could be used.

As shown in FIG. 6, the lower-layer coil 610 is connected to the upper-layer coil 620 through a layer transition or via 640 and routed to the upper-layer coil 620 without a connection bridge. As shown in the plan view of FIG. 6, the upper-layer contact terminal 634 and the lower-layer contact terminal 632 are outside the spiral. A higher inductance and lower resistance can be achieved with this configuration, which results in a higher Q-factor or efficiency for the coil device as compared to conventional coils. The coil shown in FIG. 6 with four in-plane parallel traces and with series-connected layers can be used as a Rx coil in a small appliance device to provide wireless charging. The coil shown in FIG. 6 can also be used in a transmitting (Tx) coil.

Figure 7:
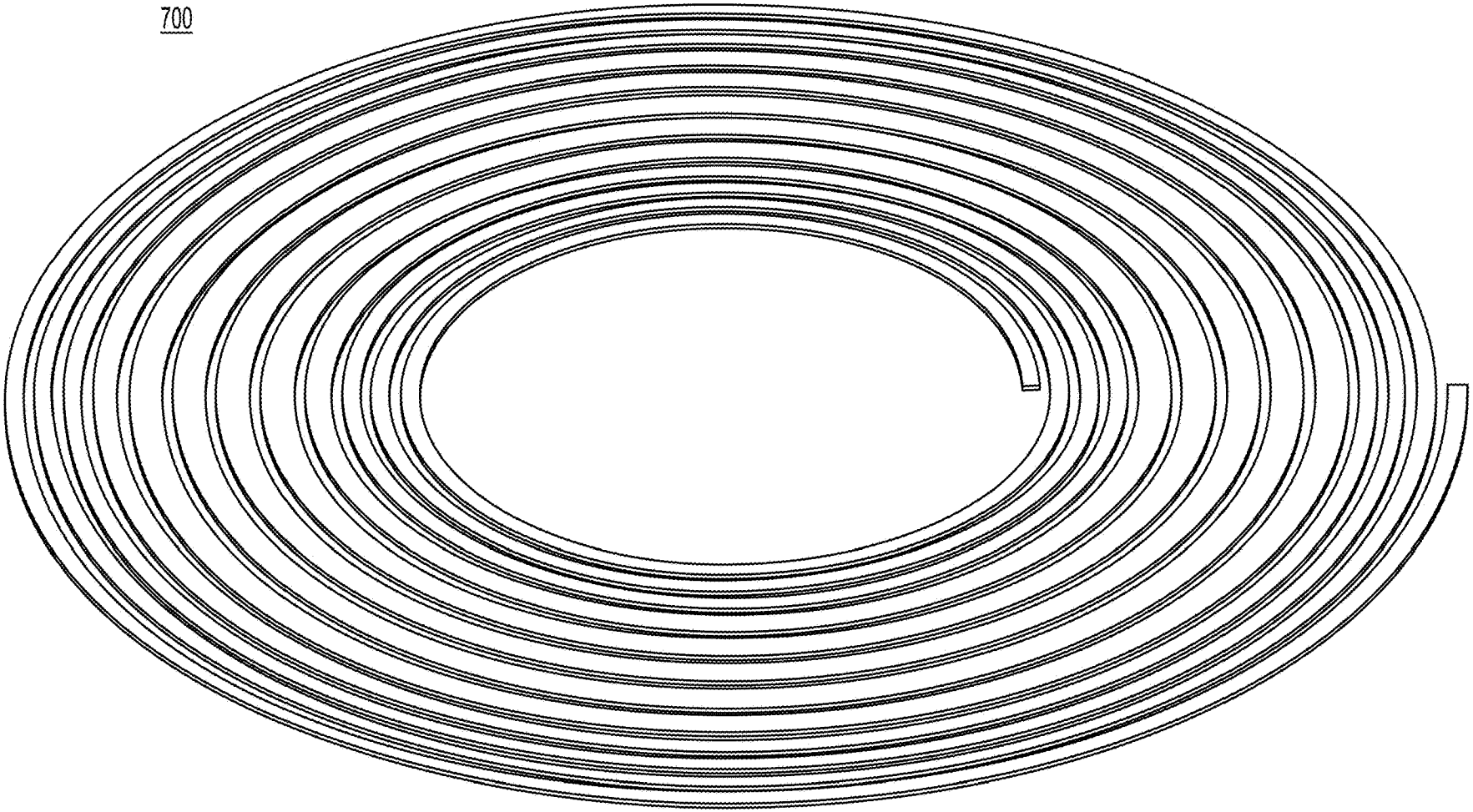
FIG. 7 is a view of a preferred embodiment of the current invention showing a conductive trace pattern of one layer of a FPC coil where the trace width is widened towards the center portion of the coil.
Figure 8:
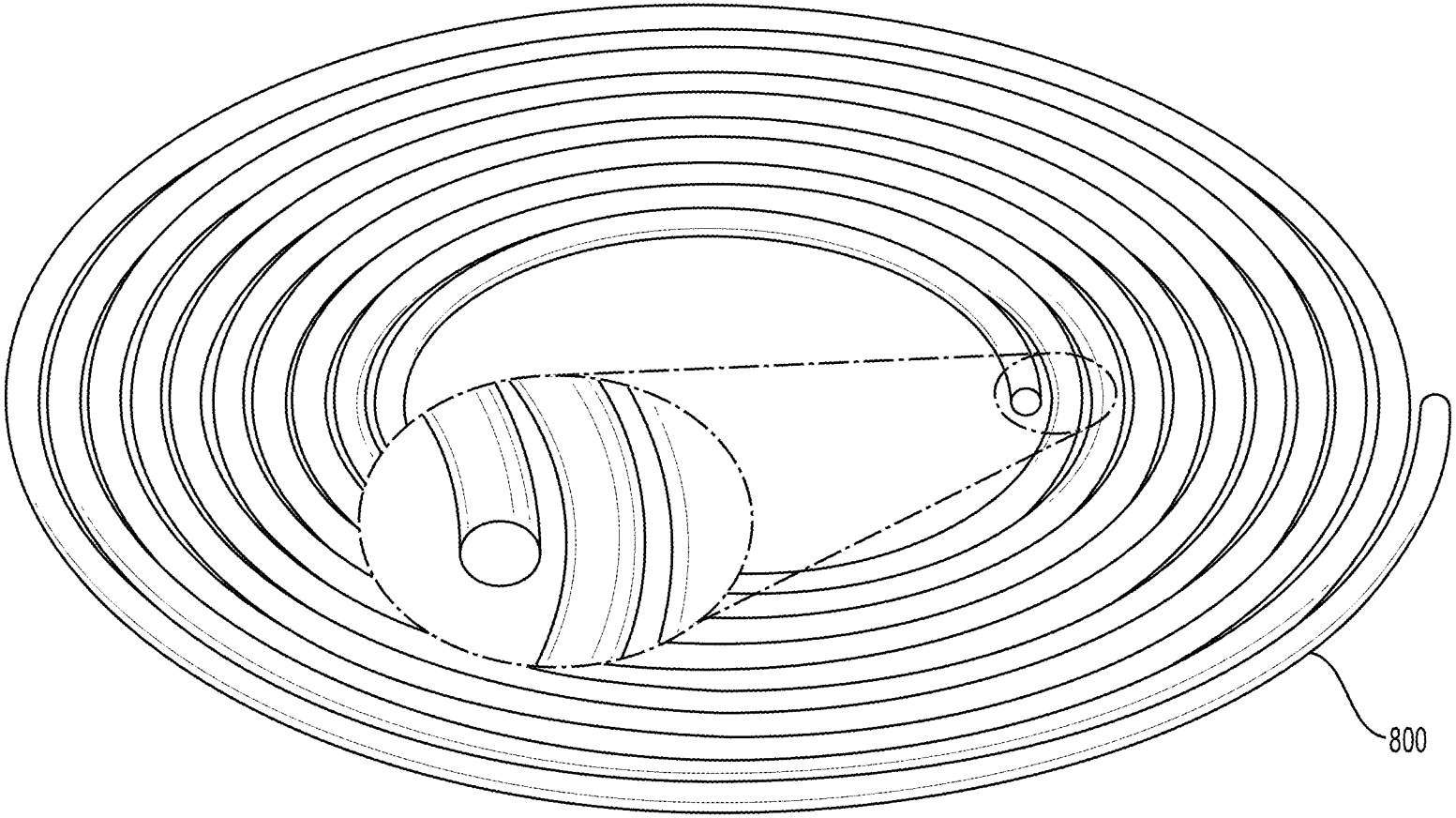
FIG. 8 (PRIOR ART)
FIG. 8 shows a conventional receiver coil.
Figure 9:
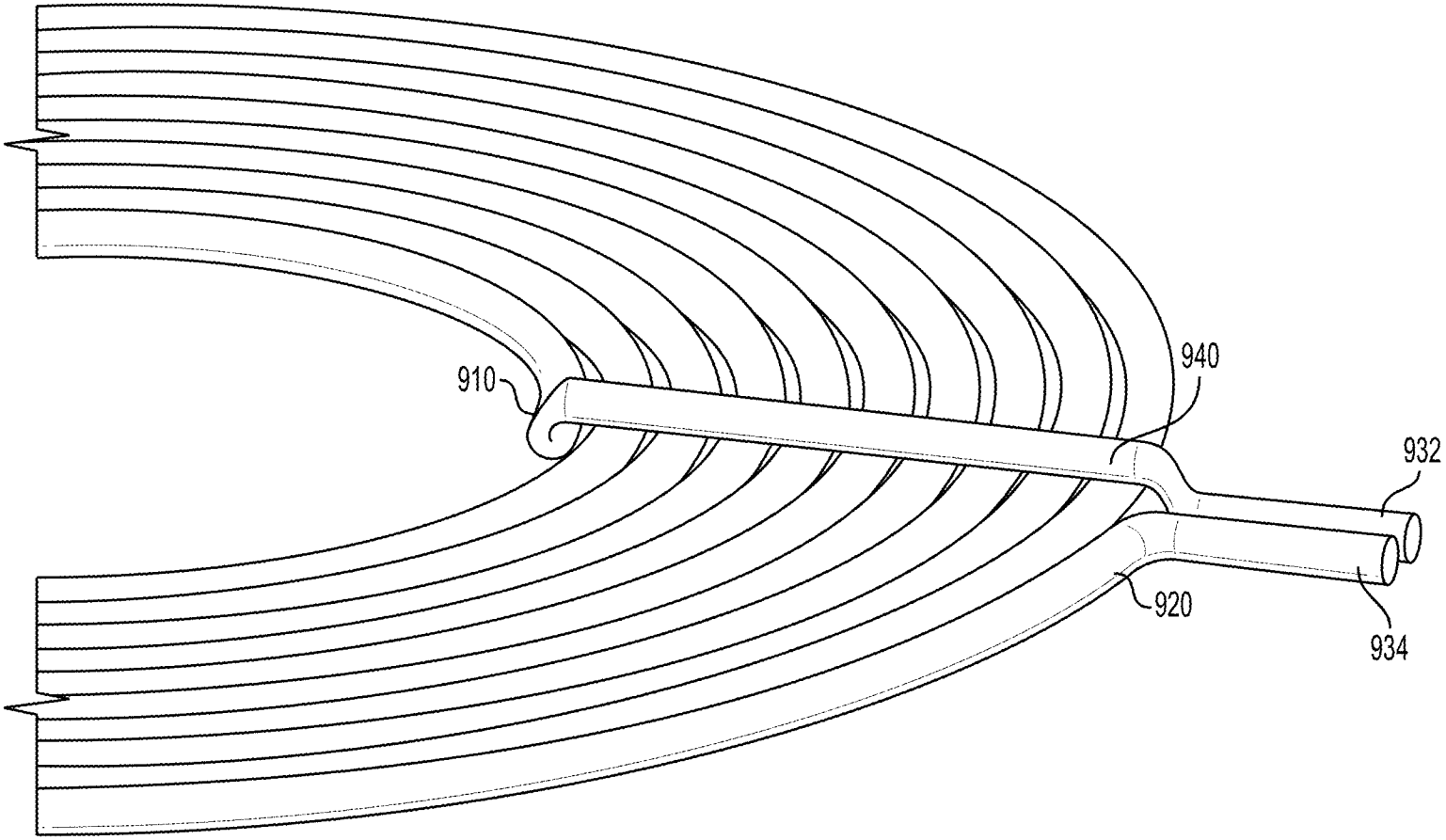
FIG. 9 (PRIOR ART)
FIG. 9 is a perspective view of a conventional receiver coil including a connection bridge.
Figure 10:
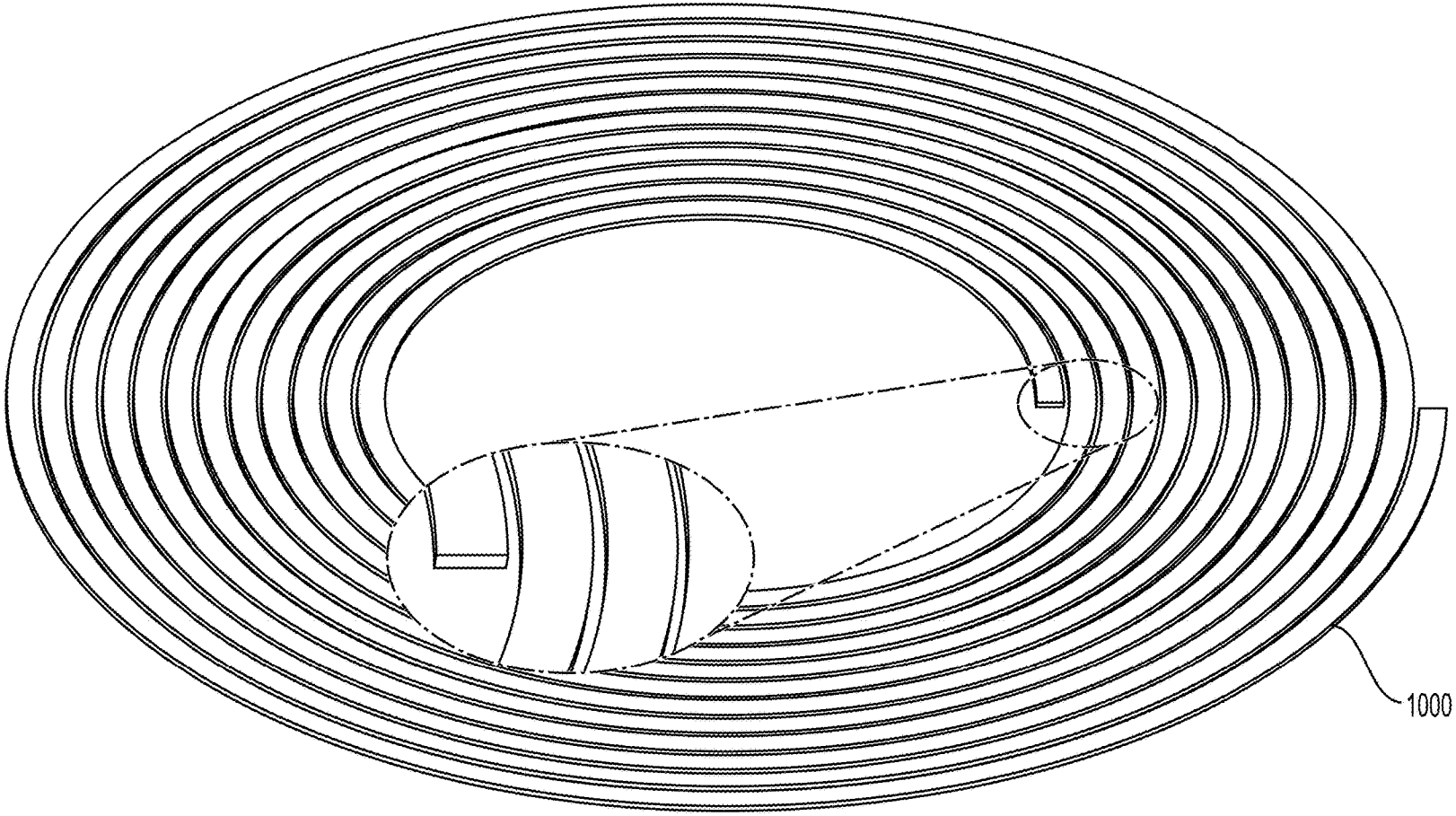
FIG. 10 (PRIOR ART)
FIG. 10 shows a conventional circular shaped FPC receiver coil.
Figure 11:
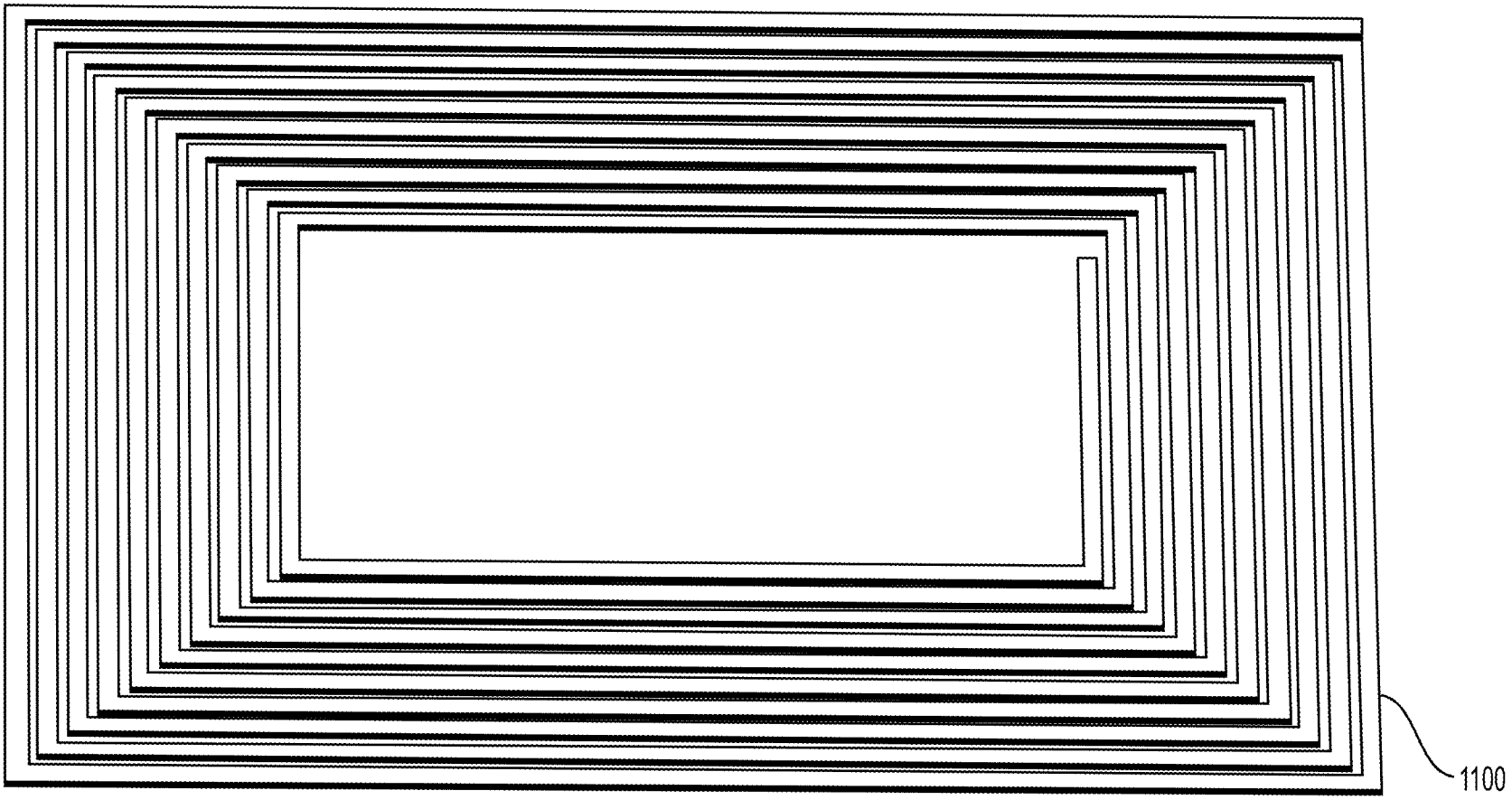
FIG. 11 (PRIOR ART)
FIG. 11 shows a conventional rectangular shaped FPC receiver coil.

Additionally, the trace width along the coil can be adjusted to further optimize coil performance. Often, coils with uniform trace patterns generate more heat around the center loops between the inner and outer loops, and conventional designs can use additional layers such as graphite to dissipate the heat concentrated in those areas. The trace width along the coil can be adjusted according to the thermal pattern of the coil. FIG. 7 shows an example conductive trace pattern of one layer of an FPC coil 700 where the trace width is widened in the center loops to reduce resistance and to create additional surface area. FIG. 7 only shows a coil 700 with a single trace, but it is also possible to a coil with for in-plane traces as shown, for example, in FIG. 1. Therefore, if the coil generates more heat in certain portions, the trace(s) in the coil can be widened in those portions to decrease heat build-up.

It should be understood that the foregoing description is only illustrative of the present invention. Various alternatives and modifications can be devised by those skilled in the art without departing from the present invention. Accordingly, the present invention is intended to embrace all such alternatives, modifications, and variances that fall within the scope of the appended claims.

What is claimed is:

1. A coil device comprising:

a first conductor on a first layer and arranged in a first spiral shape;

a second conductor on a second layer and arranged in a second spiral shape;

a transition that connects the first conductor and the second conductor in series;

a first terminal connected to an end of the first conductor; and a second terminal connected to an end of the second conductor; wherein the first terminal and the second terminal are outside of the first conductor and the second conductor when viewed in plan;

the first conductor and the second conductor each include a plurality of in-plane traces connected in parallel with each other;

a center portion of the first conductor is located farther than an inner portion from the center of the first spiral shape and is located closer than an outer portion from the center of the first spiral shape;

a center portion of the second conductor is located farther than an inner portion from the center of the second spiral shape and is located closer than an outer portion from the center of the second spiral shape; and the width of the center portion of the first conductor is wider than the width of the inner portion and the width of the outer portion of the first conductor or the width of the center portion of the second conductor is wider than the width of the inner portion and the width of the outer portion of the second conductor.

2. The coil device according to claim 1, wherein the first conductor and the second conductor have a rectangular cross section.

3. The coil device according to claim 1, wherein the first spiral shape is a circular spiral shape or a rectangular spiral shape.

4. The coil device according to claim 1, wherein the second spiral shape is a circular spiral shape or a rectangular spiral shape.

5. The coil device according to claim 1, wherein a number of layers including the first layer and the second layer is even.

6. The coil device according to claim 1, wherein the first spiral shape includes a different number of loops than the second spiral shape.

7. The coil device according to claim 1, further comprising a flexible printed circuit structure that includes the first layer and the second layer.

8. The coil device according to claim 1, wherein the plurality of in-plane traces includes at least four traces.

9. An electronic device comprising the coil device according to claim 1.

10. A method of manufacturing a coil device, the method comprising:

forming a first conductor in a first spiral shape on a first layer;

forming a second conductor in a second spiral shape on a second layer;

connecting the first conductor to the second conductor in series; and forming a first terminal connected to an end of the first conductor and a second terminal connected to an end of the second conductor terminal; wherein the first terminal and the second terminal are outside of the first conductor and the second conductor when viewed in plan;

the first conductor and the second conductor each include a plurality of in-plane traces connected in parallel with each other;

a center portion of the first conductor is located farther than an inner portion from the center of the first spiral shape and is located closer than an outer portion from the center of the first spiral shape;

a center portion of the second conductor is located farther than an inner portion from the center of the second spiral shape and is located closer than an outer portion from the center of the second spiral shape; and the width of the center portion of the first conductor is wider than the width of the inner portion and the width of the outer portion of the first conductor or the width of the center portion of the second conductor is wider than the width of the inner portion and the width of the outer portion of the second conductor.

* * * * *